US011325817B2

(12) United States Patent
Staeber et al.

(10) Patent No.: US 11,325,817 B2
(45) Date of Patent: May 10, 2022

(54) MACHINE AND METHOD FOR PRODUCING FILLED CONTAINERS

(71) Applicant: KRONES AG, Neutraubling (DE)

(72) Inventors: Tobias Staeber, Regenstauf (DE); Johannes Kugler, Nittenau (DE); Holger Mueller, Pentling (DE); Gabriel Seibold, Obertraubling (DE); Sascha Bauer, Wiesenfelden (DE); Ludovic Laine, Hainsacker (DE); Lisa Hertel, Regensburg (DE); Aurelie Boermann, Regensburg (DE); Stefan Piana, Koefering (DE); Stephanie Wunderlich, Donaustauf (DE); Ute Bedoe, Landshut (DE); Wolfgang Schoenberger, Brennberg (DE)

(73) Assignee: KRONES AG

( * ) Notice: Subject to any disclaimer, the term of this patent is extended or adjusted under 35 U.S.C. 154(b) by 0 days.

(21) Appl. No.: 16/797,981

(22) Filed: Feb. 21, 2020

(65) Prior Publication Data

US 2020/0270113 A1 Aug. 27, 2020

(30) Foreign Application Priority Data

Feb. 21, 2019 (DE) ..... 10 2019 104 379.4

(51) Int. Cl.
*B67C 7/00* (2006.01)
*B65B 55/12* (2006.01)
(Continued)

(52) U.S. Cl.
CPC ..... *B67C 7/0073* (2013.01); *B65B 7/00* (2013.01); *B65B 55/12* (2013.01); *B67C 3/001* (2013.01);
(Continued)

(58) Field of Classification Search
CPC ..... B65B 31/02; B65B 31/046; B65B 31/06; B65B 31/08; B65B 55/12; B65B 7/00;
(Continued)

(56) References Cited

U.S. PATENT DOCUMENTS 4,655,029 A 4/1987 Weiss ..... B65B 31/06
5,481,852 A 1/1996 Mitchell ..... 53/432
(Continued)

FOREIGN PATENT DOCUMENTS

DE 26 38 289 10/1977 ..... B65B 31/06
DE 3439736 4/1986 ..... B67C 3/06
(Continued)

OTHER PUBLICATIONS

US 4,514,954 A, 05/1985, Anderson et al. (withdrawn)
(Continued)

*Primary Examiner* — Andrew M Tecco
*Assistant Examiner* — Nicholas E Igbokwe
(74) *Attorney, Agent, or Firm* — Hayes Soloway P.C.

(57) ABSTRACT

A device for producing filled containers has a transport device which is configured for transporting containers which are filled with a liquid and are closed by a closure. Furthermore, the apparatus has a penetration device which is configured for producing an opening in at least one region of the closure and/or of the container, and an application device, which applies a flowable and in particular gaseous medium to the interior of the container through this opening (or feeds the gaseous medium to this interior). Furthermore, the apparatus has a closing device which closes the opening again.

15 Claims, 6 Drawing Sheets

(51) Int. Cl.

| | |
|---|---|
| ***B65B 7/00*** | (2006.01) |
| ***B67C 3/00*** | (2006.01) |
| ***B67C 3/24*** | (2006.01) |
| ***B67C 3/26*** | (2006.01) |
| *B67C 3/22* | (2006.01) |

(52) U.S. Cl.
CPC ..... *B67C 3/24* (2013.01); *B67C 3/26* (2013.01); *B67C 2003/226* (2013.01)

(58) Field of Classification Search
CPC ..... B67C 2003/226; B67C 3/24; B67C 3/26; B67C 3/001; B67C 7/0073
See application file for complete search history.

(56) References Cited

U.S. PATENT DOCUMENTS

| | | | | |
|---|---|---|---|---|
| 5,860,461 | A * | 1/1999 | Helmut | B65B 55/10 141/326 |
| 6,395,560 | B1 * | 5/2002 | Markelov | G01N 1/2226 422/68.1 |
| 7,726,352 | B2 * | 6/2010 | Py | B65B 7/161 141/11 |
| 8,376,003 | B2 | 2/2013 | Py et al. | 141/330 |
| 9,643,746 | B1 * | 5/2017 | Lunn | B65B 31/08 |
| 2012/0219455 | A1 | 8/2012 | Meinzinger et al. | A61L 2/08 |
| 2013/0239522 | A1 * | 9/2013 | Melrose | B65D 1/0261 53/467 |
| 2014/0137521 | A1 | 5/2014 | Niehr | B65B 31/025 |
| 2014/0260100 | A1 * | 9/2014 | Taber | B65B 31/06 53/436 |
| 2014/0290180 | A1 | 10/2014 | Olbrich et al. | B65B 19/32 |
| 2015/0121807 | A1 * | 5/2015 | Taber | B65B 31/08 53/431 |
| 2017/0008745 | A1 | 1/2017 | Melrose | B67C 3/22 |
| 2018/0036832 | A1 | 2/2018 | Rinker | B23K 20/004 |
| 2018/0127126 | A1 * | 5/2018 | Delage | B65B 31/006 |
| 2018/0141279 | A1 | 5/2018 | Rousseau | B29C 65/081 |
| 2018/0188101 | A1 | 7/2018 | Weindl | G01F 23/003 |
| 2019/0248524 | A1 | 5/2019 | Roidl et al. | B65B 31/00 |
| 2019/0219345 | A1 | 7/2019 | Wilson et al. | H01R 43/0207 |
| 2019/0329920 | A1 * | 10/2019 | Delage | B65B 31/006 |

FOREIGN PATENT DOCUMENTS

| | | | |
|---|---|---|---|
| DE | 20 2004 010 775 | 3/2005 | B23K 20/10 |
| DE | 10 2011 106 760 | 10/2013 | B65B 31/04 |
| DE | 10 2013 102 393 | 11/2014 | B29C 49/42 |
| DE | 10 2016 119 890 | 4/2018 | B67C 7/00 |
| DE | 10 2017 124 332 | 4/2019 | B67C 3/24 |
| EP | 0457187 | 11/1991 | B29C 65/08 |
| EP | 2491955 | 2/2012 | A61L 2/08 |
| EP | 2591864 | 5/2013 | B06B 3/04 |
| FR | 3058396 | 11/2018 | B65B 31/04 |
| GB | 1561143 | 2/1980 | B65B 31/04 |
| JP | 5985930 | 8/2016 | H01M 2/02 |
| WO | WO 2012067524 | 5/2012 | B67C 3/06 |
| WO | WO2018222055 | 6/2018 | B67C 3/04 |
| WO | WO2018083419 | 11/2018 | B65B 31/00 |

OTHER PUBLICATIONS

German Search Report issued in related German Patent Application Serial No. 10 2019 104 379.4, dated Oct. 1, 2019 with English machine translation (16 pages).
European Search Report issued in related European Patent Application Serial No. 20185744.1, dated Jun. 4, 2020 with English machine translation (11 pages).
German Search Report issued in related German Patent Application Serial No. 10 2019 104 387.5, dated Oct. 7, 2019 with English machine translation (18 pages).
European Search Report issued in related European Patent Application Serial No. 20185687.2 dated Jun. 2, 2020 with English machine translation (12 pages).
German Search Report issued in related German Patent Application Serial No. 10 2019 104 390.5, dated Oct. 1, 2019 with English machine translation (18 pages).
European Search Report issued in related European Patent Application Serial No. 20158709.4, dated Jun. 2, 2020 with English machine translation (12 pages).
European Office Action issued in related European Patent Application Serial No. 20158687.2, dated Jul. 12, 2021, with English machine translation (8 pages).
Office Action issued in U.S. Appl. No. 16/797,962, dated Jun. 14, 2021, 19 pages.
Office Action issued in U.S. Appl. No. 16/798,068, dated Jul. 8, 2021, 27 pages.
Quintino, "Introduction to joining methods in medical applications", published 2013.
Sonotronic (https://www.sonotronic.de/technologies/ultrasonic/ultrasonic-embossing published 2016).
Office Action issued in related U.S. Appl. No. 16/798,068, dated Oct. 22, 2021 (19 pages).
U.S. Appl. No. 16/798,068, filed Feb. 21, 2020, Siebold et al.
U.S. Appl. No. 16/797,962, filed Feb. 21, 2020, Bauer et al.
Office Action issued in related U.S. Appl. No. 16/798,068, dated Feb. 2, 2022 (18 pages).

* cited by examiner

MACHINE AND METHOD FOR PRODUCING FILLED CONTAINERS

BACKGROUND OF THE INVENTION

The present invention relates to a device and a method for producing filled containers. Numerous such devices and methods are known from the prior art. Usually a container is first of all filled with a liquid and then closed with a closure. In this case methods are known from the prior art in which, in the case of containers which are not yet closed, an inert gas is introduced into the head space of the containers in order thus to prolong the shelf life of the corresponding beverage. This procedure is known in particular in the case of so-called hot-fill processes, in which a heated liquid is introduced into the containers.

More recently, however, methods have also become known, in which the containers are first of all closed, for example with a plastic closure, then this plastic closure is drilled through again and the inert gas is introduced into the head space of the container through the opening thus produced. Next the opening which was produced is closed again.

Although these procedures are on the one hand very promising, they are currently not yet ready for series production.

Therefore the object of the invention is to bring such devices known from the prior art to a state of readiness for series production.

SUMMARY OF THE INVENTION

A device according to the invention for producing filled containers has a transport device which is suitable and intended for transporting containers which are filled with a liquid and are closed by a closure.

Furthermore, the device has a penetration device which is suitable and intended for producing an opening in at least one region of the closure and/or of the container, and an application device, which applies a flowable and in particular gaseous medium to the interior of the container through this opening (or feeds the gaseous medium to this interior).

The closures are preferably closures which have been manufactured in a compression moulding process. In a further preferred device these are closures which have a continuous or substantially continuous wall thickness.

In addition it would also be conceivable for closures to be used which have been produced in an injection moulding process.

In a further procedure the closure is designed in single-layer form. The closure here preferably has no so-called liner on its inner side.

Furthermore, the device has a closing device which closes the opening again (and which closes the opening again in particular after the application of the gaseous medium to the interior).

It is pointed out that, starting from the basic structure of the machine described above, further embodiments according to the invention are possible. The applicant reserves the right to claim such embodiments if applicable in the context of further patent applications and in particular further divisional applications. The following description does not definitively describe an individual embodiment according to the invention. Therefore the applicant reserves the right also to claim further subjects based on the basks structure described here, regardless of the embodiments described below.

In a first embodiment according to the invention the system has a sterilising device which sterilises at least a region of the closure and/or of the container. This embodiment takes account of the fact that due to the production of the opening and the subsequent opening of the container a pollution or contamination of the beverage may occur.

For this reason it is proposed that at least a region of the container or of the closure (in particular the region in which the said opening is or has been introduced) is to be sterilised. This is in particular a region of the outer wall. As mentioned below, this sterilisation can take place in different ways, for instance by heating or also UV radiation or the like.

This first measure according to the invention makes it possible in particular also to achieve the readiness for series production of corresponding installations, since in this way, as explained in greater detail below, series production or industrial production of containers is made possible.

In a preferred method the containers are filled with a heated liquid and in particular with a heated beverage. During the filling the liquid preferably has a temperature which is greater than 30°, preferably greater than 40°, preferably greater than 50° and particularly preferably greater than 70°.

In a second embodiment according to the invention the closing device has an ultrasound generating device.

This procedure also serves for ensuring a reliable closure. Closing devices, which for instance warm the region of the opening of the lid again by heating, are known from the internal prior art of the applicant. In this case, however, only a specific region of the lid is heated and in this way is welded. By the use of an ultrasound generating device a more reliable welding of the produced opening can be achieved, in particular because the welding takes place deeper in the material. The welding with ultrasound also prevents the occurrence of toxic gases as in the case of heat fusion. Moreover, no molten material can drop off from the lid into the container.

In a further embodiment according to the invention the device has at least one inspection device, which monitors at least one device of the apparatus and/or the apparatus has at least one monitoring device, which monitors at least one parameter which is characteristic for the production of the filled containers. Also in this embodiment the operational safety or the process safety of the containers thus produced is ultimately increased. In addition, this measure also contributes to the containers being produced in continuous production.

In a further embodiment according to the invention the device has at least one cleaning and/or sterilising device, which is suitable and intended for cleaning and/or sterilising at least one device of the application device (and/or of the penetration device).

In this embodiment it is assumed that the application device (and/or the penetration device) has for example elements to be cleaned or to be sterilised, such as for instance feed conduits for a gaseous medium or the like. In this case, depending upon the application, for example depending upon the filled element, a different degree of cleaning or sterilisation may be necessary. Accordingly, different cleaning and/or sterilising media may also be used.

This cleaning and/or sterilising device is preferably active in a cleaning mode, which differs from a usual operating mode, in which the containers themselves are processed.

Furthermore, it is also possible that the cleaning and/or sterilising device cleans or sterilises different elements of the machine, such as for instance also the penetration device or also the closing device.

In a further embodiment according to the invention the application device facilitates the application to the container of a first pressure and a second pressure which differs from the first pressure. In this procedure it is proposed in principle that the medium is fed through the opening with different pressures.

As mentioned above, in such methods containers and in particular hot-filled containers are generally pierced by the closure after recooling, and are acted upon by a gaseous medium, in particular an inert gas and in particular nitrogen, under pressure.

As mentioned above, this takes place in order to bring unstable containers, which have "collapsed" after recooling due to the cooled head space gas, back into shape and also to make them stackable. In this embodiment it is proposed, in order to receive gas as quickly as possible into the head space of the pierced bottle, first of all to bring gas quickly at a high pressure into the head space, in order thus to keep the process time and thus also a possible corresponding machine small. With a small, considerably lower pressure the required final pressure is then set in the head space.

A first pressure is preferably a pressure which is greater than 2 bars, preferably greater than 2.5 bars, preferably greater than 3 bars and preferably greater than 3.5 bars.

The first pressure is preferably a pressure which is less than 10 bars, preferably less than 9 bars, preferably less than 8 bars, preferably less than 7 bars and preferably less than 6 bars. A pressure in the region of approximately 4 bars is particularly preferred.

The second pressure is in particular a pressure which defines the required final pressure in the head space. This may be for example a pressure of 0.3 (positive pressure), that is to say 1.3 bars. This second pressure is preferably greater than 0.1 bars (positive pressure), preferably greater than 0.2 bars (positive pressure) and particularly preferably greater than 0.25 bars (positive pressure).

This second pressure is preferably less than 3 bars (positive pressure), preferably less than 2.5 bars (positive pressure), preferably less than 2 bars (positive pressure), preferably less than 1.5 bars (positive pressure), preferably less than 1 bar (positive pressure) and preferably less than 0.5 bars (positive pressure).

The pressures mentioned here may also be designated below as pressure stages.

In a preferred embodiment the closing device is likewise movable and in particular is movable towards the container. Thus for example the closing device may be a rod-like body, the tip of which is heated and which is movable towards the container. The closing device is preferably movable in a rectilinear direction of movement in this case this direction of movement is preferably oblique with respect to a longitudinal direction of the container to be treated.

The closure of the container is preferably a plastic closure. In a further preferred embodiment the container itself is also a plastic container and in particular a deformable plastic container.

In a further preferred embodiment the sterilising device is suitable and intended to sterilise at least one region of the opening. In this way a contribution is made to ensuring that no contaminants or germs can enter into the interior of the container through this region.

In a further advantageous embodiment the sterilising device has a radiation device, which applies electromagnetic radiation and in particular high-energy light, for example high-energy UV light, to at least one region of the container, and/or a heating device which heats at least one region of the container. In this embodiment two different procedures for sterilisation are proposed, specifically on the one hand the heating in particular of a region of the opening and/or the irradiation by light. This electromagnetic radiation may be for example ultraviolet radiation, but also electron radiation, X-ray radiation or radioactive radiation.

In addition, however, the application of the closure of a gas, for instance a sterile gas or a sterilising gas, such as for example $H_2O_2$, to the closure is also possible for sterilisation. It is also possible that the sterilising device is implemented in that the process of producing the opening in the closure also takes place during the application of a sterilising gas.

In a further preferred embodiment the sterilising device has a heating device which can be moved towards the region of the closure and/or of the container which is to be sterilised, in order to sterilise this region. In this case this movability may be provided by a movement of the sterilising device, but also by a movement of the container.

The sterilising device is preferably designed in the manner of a punch which can be lowered onto the closure. Particularly preferably a driving device is provided, which moves at least one element of the sterilising device onto the closure. This may be for example an electric drive, a hydraulic drive or a pneumatic drive. Particularly preferably a pneumatic drive is used.

In a further advantageous embodiment the device has a control device which causes the sterilising device to sterilise the region of the container and/or of the closure after the perforation device has introduced the hole. Thus in this case first of all the hole is introduced and then the region is sterilised, for example heated or acted upon by UV light. In this case it is also possible that there is a mechanical coupling between the perforation device (for example a needle) and the sterilising device.

In a further advantageous embodiment the device has a sterile room inside which the containers are at least partially transported. In this case it is possible for the entire device to be arranged inside a sterile room, but it would also be possible for the transport path of the containers and/or the containers themselves to be routed inside the sterile room, whilst other regions of the apparatus, for instance parts of the transport device, are arranged outside this sterile room. Thus for example the sterile room could surround the containers toroidally.

The sterile room is preferably delimited by means of at least one wall with respect to unsterile surroundings. The sterile room is preferably delimited by means of at least two walls with respect to unsterile surroundings, wherein these walls are particularly preferably movable with respect to one another.

A sterilising device is preferably provided which sterilises the containers and/or the closures already before the actual device.

Thus it would be possible for example that a sterilisation for instance by means of $H_2O_2$ or peracetic acid, but if applicable also by means of electromagnetic radiation, takes place before the actual device, for instance in an inlet tunnel. In this case the lid and/or the entire containers can be sterilised for instance in an $H_2O_2$ tunnel. In order to avoid repeated contamination of the closures and/or the containers, in the embodiment described above the device is set up in a sterile room and/or isolator technology.

At least one ventilation device is preferably provided, which applies a positive pressure of a gaseous medium, in particular but not exclusively sterile air, to this isolator or the interior thereof. In this way penetration of germs into the isolator or sterile room can be avoided. In addition, a sterilising gas, in particular in a low concentration, may also be present in the isolator or dean room in order to prevent contamination. $H_2O_2$ can also be used for sterilisation of the corresponding feed conduits, for instance the conduits leading into the clean room. The same also applies to the processing head.

In a further preferred embodiment the apparatus has a cleaning device for cleaning the apparatus itself, for instance so-called CIP (cleaning in place). In this case a cleaning mode can be provided, during which the apparatus itself is cleaned.

In a further preferred procedure or a hygiene concept a lid sterilisation, in particular in the inlet region, by means of pulsed light is provided, in which one or more lids can be sterilised at once. In this case the device has a radiation device which is suitable for emitting a pulsed radiation, for instance UV radiation, electron radiation, X-ray radiation or the like.

In order to prevent repeated contamination of the lid, the device is preferably equipped with a clean room roof which generates a corresponding air flow with sterile air. Hot steam is used for example for sterilisation of the corresponding feed conduits and of the processing head.

In addition, the apparatus preferably has a drying device which facilitates drying of devices of the apparatus after sterilisation thereof. Thus it would be conceivable for instance that after the sterilisation (for instance with hot steam) the plant is dried again by air flow.

In a further preferred embodiment the transport device transports the containers individually. In this case in particular the containers are gripped individually. In this case it is possible that the transport device grips the containers at least also on the neck or the mouth thereof.

In a further advantageous embodiment a closing of the opening takes place by a material change and in particular by (partial) melting of the plastic material of the closure and/or of the container.

In a further advantageous embodiment the penetration device has a piercing device and in particular a needle. This can be designed for example as a solid needle or as a hollow needle.

The transport device is preferably designed as a rotary device. In a further advantageous embodiment the application device is suitable and intended to apply a positive pressure of gaseous medium to the head space of the container or to the container. This may be for example a positive pressure of three or four bars.

In a further advantageous embodiment the closing device has an advancing device which moves at least one element of the ultrasound generating device towards the opening, in this case this advancing device can have a drive which is selected from a group comprising electric drives, hydraulic drives and pneumatic drives. Particularly preferably the advancing device has a pneumatic drive.

Particularly preferably the advancing device is suitable and intended for advancing an ultrasound element completely towards the container, that is to say in such a way that it contacts the container. However, it would also be possible that an (in particular small) spacing is maintained between the container and the ultrasound generating device.

In a further advantageous embodiment the ultrasound generating device has a sonotrode.

In a further preferred embodiment the ultrasound generating device is integrated into a punch which at least temporally contacts the container and/or the closure. This punch can preferably be advanced towards the container and in particular towards the opening to be closed and the surroundings thereof, and the ultrasonic signal can be activated. Particularly preferably, the apparatus has an ultrasound generating device which is suitable and intended for generating the ultrasonic signal which energises the said sonotrode or another ultrasound generating element.

However, it would also be possible and preferred to activate the ultrasonic signal already before the punch is advanced towards the container. In this way the processing time can be kept short or as short as possible.

In a further advantageous embodiment the ultrasound generating device has a piezoelectric element.

In a further advantageous embodiment the ultrasound generating device has a generator device which is suitable and intended for generating an ultrasound, the frequency of which is greater than 20 kHz and/or the ultrasound generating device has a generator device which is suitable and intended for generating an ultrasound, the frequency of which is less than 35 kHz. However, it would also be possible for other frequencies to be used, for instance frequencies in the region of 70 kHz.

In a further advantageous embodiment the apparatus has a sensor device which at least partially or at least temporarily determines a parameter which is characteristic for the ultrasonic welding process. In this case for example a heating of the plastic material can be determined, but it can also be checked whether the sonotrode is active or whether an ultrasonic signal is emitted. In other words, it is possible that this sensor system can monitor both the ultrasound and also the respective welding result at the welding point.

Thus for example it can be tested whether an ultrasonic signal is present, or also a test can be carried out indirectly for instance by means of electric currents. In a preferred embodiment the sensor device has a power measuring device.

In a further advantageous embodiment the device has a plurality of transport units which are preferably arranged one alter the other and which transport the containers. Thus for example the container can be advanced by a further transport device towards the device described here. In this case it is also possible that a transfer device is provided which forms a transition from base-guided transport of the containers to neck-guided transport of the containers.

In a further advantageous embodiment the apparatus has a separating device which converts a stream of containers into successive individual containers. Thus for example a dividing screw can be provided in the inlet of a machine.

In addition, a screwless inlet would also be possible. In this case it is possible that the containers are transferred to one or more feed starwheels, depending upon the machine arrangement. In a further preferred embodiment a lifting or lowering of the individual containers also takes place, if necessary, in order to achieve a uniform level for the transfer into a neck processing or neck transport region. In this case it is possible that lifting of the containers takes place for example by means of lifting curves on a neck ring.

In addition, a lifting starwheel can also be provided. It would also be conceivable that the containers are held down during transport or that a lowering curve is provided. In addition it is also possible that the containers fall freely over a specific (in particular short) falling distance or also a planar neck handling guide is present.

In a further advantageous embodiment a transfer into a neck handling clamp takes place. In this case additional guides can be provided, where appropriate, in particular in the region of a transfer and preferably also with an engagement in a closure region or in a region in which the containers are transported on their necks.

In a further preferred embodiment the sterilising device is configured in such a way that it facilitates a sterilisation of the closure or lid with the containers closed. In this case it is possible that the container lids are already sterilised in a closed state for the process. This can be facilitated by means of one or more dry or wet methods. As mentioned above, the sterilisation can take place for example by means of ultraviolet light, $H_2O_2$, chlorine dioxide, hot steam, peracetic acid and also electron beams and the like.

In a further advantageous embodiment a sterilising device is also provided which sterilises the penetration device or piercing device, for example a needle. Such a sterilisation can be carried out for example by means of a temperature or heating and/or by means of a sterilising medium, such as for example ultraviolet light, $H_2O_2$, chlorine dioxide, hot steam and/or the penetration device can be kept sterile by corresponding procedures.

In a preferred embodiment it is possible that the procedures or processes described here are carried out in a linear machine. Thus for example containers can be processed directly on a transporter. Thus corresponding processing heads can be transported for example above or over a drag chain, by means of a linear motor, by means of a pneumatic guide or the like. Furthermore, both a continuous operation of the transport device and also a cycle control operation are possible.

A plurality of variants are conceivable for the sterilisation with a gas and for example $H_2O_2$. Thus for example an $H_2O_2$ reservoir could be arranged in the application device, for instance the application head. In addition, in particular in the event of application of UV light, a pulsed light could be integrated in the head. In the embodiment with $H_2O_2$ in a head, a sterilisation of the head and the accessories by means of $H_2O_2$ is conceivable. Furthermore, it is also preferable that after the placement on the container an internally located zone of the container is flushed with $H_2O_2$ in order to sterilise this region.

In the embodiment with light pulses, for instance with ultraviolet pulses, a sterilisation of the head and the attachments by means of UV light can be provided. Furthermore, after the placement onto the container the internally located zone of a container can be processed with UV light, in order to sterilise this region.

During sterilisation with other media, such as for example chlorine dioxide, peracetic acid or also during the sterilisation by means of electron beams it is also conceivable to keep a head or the application device sterile by means of temperature.

In the case of chlorine dioxide wet sterilisation, for instance of the lids, by means of the action of $ClO_2$, sterilisation upstream of the actual device is also conceivable. Thus a corresponding sterilisation could be performed already upstream of a recooler connected upstream of the device described here.

A sterilisation of the lid by means of electron beams (e-beam) can be provided either in an inlet region of the apparatus or directly in the head of the application device.

In the case of sterilisation by means of peracetic acid or a wet sterilisation of the lid or of the containers, sterilisation inside an isolator is also conceivable. In this case both sterilisation of the isolator and also of feed conduits can take place. This can also be carried out, where appropriate, by means of peracetic acid.

In a further advantageous embodiment the inspection device and/or the monitoring device is suitable and intended for delivering at least one value which is characteristic for the device of the apparatus and/or the production of the filled containers.

Particularly preferably the value which is characteristic for the device of the apparatus is selected from a group of values which includes a value which is characteristic for a physical property of the penetration device, a value which is characteristic for positioning of the penetration device relative to the container and/or to the closure, a value which is characteristic for a relative movement between the penetration device and the container, a value which is characteristic for focusing of a light beam, a value which is characteristic for the application device, a value which is characteristic for the closing device, in particular a temperature value or the like.

It is therefore proposed that such values are determined which are relevant for a reliable penetration and/or application and/or sterilisation and/or closing process. This may concern for example the state of a penetration needle, and for example it can be checked whether this has broken off or is generally still intact. A plurality of such values can also be determined.

In addition, the concentration of a sterilising medium can also be measured.

In a further advantageous embodiment the inspection device and/or the monitoring device has a sensor device which is selected from a group of sensor devices which includes temperature sensors, pressure sensors, acceleration sensors, motion sensors, distance sensors, acoustic sensors, proximity sensors and the like.

In a further advantageous embodiment the device has a storage device which stores the values output by the respective sensor device. In addition a comparison device is preferably provided, which compares the values output by the sensor device or sensor devices with reference values, in particular with reference values stored in a database.

In a further advantageous embodiment the apparatus can have a control and/or regulating device which controls the apparatus taking into consideration the values output by the sensor device or the sensor devices.

In a further preferred embodiment the value which is characteristic for the production of filled containers is selected from a group of values which includes temperature values, pressure values, in particular a pressure value in the interior of the container, speeds, accelerations, optical parameters and the like. This may be for example the temperature of the liquid in the container, or also the temperature of a welding punch which seals the opening which is produced. In addition, such values can also be recorded over a relatively long time. A prediction about a state of wear can be made by means of such values.

In addition it is also possible for the piercing to be tested optically for instance in a container closure.

Furthermore, a temperature measurement can be facilitated, for instance a temperature measurement of a sealing point.

In addition it is also possible that measurements, for instance pressure measurements, are carried out on the container before and after the corresponding method has been carried out.

In a further preferred embodiment the inspection device is suitable and intended for determining the relevant value contactlessly. Thus for example the inspection device is a camera or also a proximity sensor or the like.

In a further advantageous embodiment the device has an error generation unit which is suitable and intended for generating operating errors. In this case it is proposed that first of all an error is deliberately generated in order to check the inspection unit, that is to say this inspection device must then identify this error. Thus it is possible for example that erroneous sealing is intentionally generated in order to check the subsequent inspection device, that is to say to check whether this device can also identify this error.

In a preferred procedure a needle inspection could take place between a feed starwheel for the containers and a discharge starwheel for the containers. Thus it would be conceivable that the penetration device, for example a needle, is briefly extended in order to be recorded by at least one camera, preferably by two cameras, which are preferably offset by a predetermined angle with respect to one another.

Since in practice such an inspection only rarely finds or reports errors, self-checking is advantageous. This can take place for instance in that at intervals the needle is not extended and the camera must then report this provoked error as verification of the correct inspection function.

In a preferred embodiment an inspection device is provided, which facilitates thermal monitoring of the welding point. Thus for instance sensors such as infrared camera or thermopiles can be provided which, after the welding, check whether a local heating by a minimum temperature difference is measurable at the welding point.

In addition, it is also possible and preferable that the penetration device is inspected and/or checked. Thus for instance a needle, the puncture hole produced by this needle and/or the shape of a welding point can be checked. In this case for example a recognition of the position of the hole and/or welding point with respect to an outer edge of the closure, a roundness of the hole and/or of the welding point, the diameter of the hole and/or welding point, a curvature of the hole and/or welding point on the closure is conceivable.

The inspection device preferably has an image capturing device such as in particular but not exclusively a camera which observes the puncture hole and/or the welding point. In this case this image capturing device be arranged in particular above the container closure.

The apparatus preferably has an inspection device which serves to check the closure and/or the internal pressure of the container. This can take place for example by means of a bulging of the container closure. In this case this inspection device can for example have an optical means. Thus for example a single-point laser triangulation sensor can be provided, which records a height profile of the closure and in particular the closure passing through below it.

From a curvature of a recorded measurement curve a conclusion can be drawn as to the internal pressure and thus for example the presence of a leak. Even if the bulge changes or deviates on the basis of slowly changing environmental conditions, individual more significantly divergent formwork profiles are identified. The identification is even more reliable (although more elaborate) if a flat surface profile of the closures is recorded.

As mentioned, the penetration device, which may for instance have a needle, can also be optically inspected. Therefore an inspection device is preferably provided, which in particular optically inspects at least one element of the penetration device. The penetration device or the needle is preferably examined with regard to a property which is selected from a group of properties which includes bending of the needle, bluntness of the needle, any needle breakage present, a position or length of the needle, the presence of residues on the needle and/or the presence of contaminants on the needle.

Especially if multiple devices such as those for sterilisation, for penetration or for reclosing are present, as is typically the case in rotary machines, it is proposed to individually monitor these devices and in particular to individually monitor them statistically. For this purpose a plurality of measurements of one or more properties for each individual device are aggregated statistically in order, in the context of preventive maintenance, to detect deviations at an early stage before they affect the production. The statistical aggregation, for example an averaging over many measurement values, in this case allows substantially greater precision than individual measurements. If trends are then derived from time series, it is possible for example to predict at an early stage when a wear limit is reached.

Furthermore, the present invention relates to a device for producing filled containers, comprising a transport device which is suitable and intended for transporting containers which are filled with a liquid and are closed by a closure. Furthermore, a penetration device is provided which is suitable and intended for producing an opening in at least one region of the closure and/or at least one region of the container, and also an application device, which applies a flowable and in particular gaseous medium to the interior of the container through this opening. Furthermore, a closing device is provided which closes the opening.

According to the invention, the apparatus here has a changing device which is suitable and intended to change at least one device of the apparatus.

This may for example be an element of the penetration device, such as for instance a needle or the like. Furthermore, this device of the apparatus could be an element of the application device or also an element of the closing device.

This changing device is preferably suitable and intended for automatically carrying out the specified changing. Thus it is possible that in the event of damage to the penetration device, for example the needle, this can be replaced automatically.

In a further advantageous embodiment the apparatus also has a holding device for holding at least one and preferably a plurality of such elements, such as for example one or more corresponding needles. This holding device or this magazine can be placed in a specific position, so that in the event of a damaged needle or penetration device this position can be approached and a replacement can be carried out by means of a changing system and/or a robot.

In addition, it is also possible that the changing device itself is integrated into the penetration device. Thus a magazine, which replaces a needle in the event of damage, can be located for example in the processing head. Thus for example a damaged needle can be ejected and replaced by a new one.

In general the penetration device and the closing device can be arranged and/or moved in a different manner. Thus it would be conceivable that both the penetration device and also the closing device are delivered to the container and/or to the container closure with the same direction of movement. In this case the penetration device and the closing device could be arranged for instance on a support which is configured in the manner of a revolver drum.

In addition the directions of movement of the respective feeding movements relative to one another also extend or are inclined at an angle different from 0°. In this case it would be possible that one of the two elements is perpendicular to the container wall and/or closure wall, but it would be also be possible for both elements to be inclined obliquely relative to the respective wall to be punctured.

In order to avoid the occurrence of transverse forces due to inclined impingement on the portion to be drilled through and/or to be closed, the two devices can be placed perpendicularly onto the surface to be drilled. In this case a moving device is preferably provided, which moves at least one of the two devices at least also in a direction perpendicular to the piercing direction, such as for instance the above-mentioned revolver drum-like device.

In other words a reciprocating motion of the components can preferably be carried out, which for instance can preferably take place by a horizontal displacement of the penetration device and/or the closing device or can also be implemented by a rotary movement.

In addition the container itself could also be moved, in particular transversely, in particular perpendicularly with respect to the longitudinal direction thereof relative to the penetration device and/or the closing device.

Particularly preferably a plurality of stations are arranged on the transport device, and preferably in each case have the above-mentioned devices, that is to say in each case they have an application device, a penetration device and/or a closing device.

Particularly preferably the cleaning and/or sterilising device is suitable for applying a flowable cleaning medium, as described in greater detail below, to devices of the application device(s).

In a further embodiment according to the invention the application device enables the application to the container of a first pressure and a second pressure which differs from the first pressure. Thus it is possible for example that first of all a higher positive pressure, for example a pressure of four bars, is applied to the container and following this a pressure is applied which then corresponds substantially to the internal pressure of the container, for example a pressure von 1.3 bars (or 0.3 bars positive pressure relative to ambient pressure). In this case in particular this is the pressure of the flowable medium, which is introduced into the container through the opening which has been introduced.

In a preferred embodiment the application device has at least one feed conduit which feeds the medium to the interior of the container and in this connection the sterilising device is suitable and intended for flushing this feed conduit with a cleaning and/or sterilising medium. In a preferred embodiment the application device has at least two feed conduits which feed the flowable medium to the interior of the container and in this connection the sterilising device is suitable and intended for flushing both feed conduits with a cleaning and/or sterilising medium.

In addition the application device can have an application chamber which is fluidically connected to the interior of the container, and leads into the at least one, preferably both feed conduits.

In a further advantageous embodiment the cleaning and/or sterilising device has at least one stationary feeding device for a cleaning and/or sterilising medium. In this case it is possible that such feeding means or also a corresponding reservoir for the cleaning and/or sterilising medium are arranged in a stationary region of the machine and in particular this cleaning and/or sterilising medium is transported to a movable part of the device.

In a further preferred embodiment the application device is arranged on the transport device. This means that the application device is transported with the transport device.

The machine particularly preferably has a plurality of such application devices. Thus for example a plurality of corresponding stations can be provided, on which, as mentioned above, in each case penetration devices, an application device and/or closing devices are arranged.

In a further advantageous embodiment the device has a distribution device which distributes at least one flowable medium from a stationary feeding device to a plurality of application devices. In particular this distribution device can be a so-called rotary distributor which, starting from a stationary feeding means, distributes to a plurality of application devices which are arranged on the transport device and are thus movable therewith.

In this case, however, it is possible that the actual sterilisation or cleaning takes place in a stationary state of the application devices. Furthermore, it is also possible that the said distribution device is also suitable and intended for distributing the flowable medium during operation from a stationary plant part to the individual application devices.

In a further advantageous embodiment the apparatus has a stationary supply device for supplying the flowable medium. Thus it is also possible that, starting from a stationary part of the plant, the flowable medium which is applied to the containers in normal operation is transferred to a moving and in particular rotating part of the plant.

In a further advantageous embodiment the apparatus has a selection device and/or switching device which facilitates the selective feeding of the application device with the flowable medium or the cleaning and/or sterilising medium. In this case it is possible that, as described in greater detail below, the apparatus has two different operating modes and the selection device, for instance a valve, can cause the application device to apply either the flowable medium or the cleaning and/or sterilising medium.

In a further preferred embodiment the flowable medium (which serves for sterilisation and/or cleaning) is a gaseous medium and in particular a medium such as steam, hydrogen peroxide or the like. However, sterilisation with a liquid medium would also be possible.

In a preferred embodiment at least one of the (above-mentioned) pressures or one of the pressure stages by which the medium is applied to the container is provided by means of a pressure reservoir.

In particular, when a rotary machine is used it is generally necessary to transmit the two pressure stages to the rotating part of the machine or to reduce the pressure in the rotation, in particular in order to keep a corresponding media distributor simple.

However, a pressure reduction in the rotation is only possible to some extent, since the fittings, in particular a pressure reducer, are not hygienic components and thus the entire conduit cannot be steam-treated in order to maintain the hygiene.

If a reduction of the pressure takes place with a valve manifold and with separate conduits is transmitted into the rotating part of the machine, this would lead to a complicated construction of the media distributor.

In addition, a pressure reduction in a conduit and a subsequent decrease always requires a highly precise setting and co-ordination of regulators, since a reduction has an immediate effect on the volume present in the pipe. Then the pressure frequently fluctuates, so that consequently the same pressure is not present in the head space in every container.

The above-mentioned embodiment therefore proposes to provide a pressure reservoir on the rotating part or the moving part of the plant. More precisely, the starting point for this idea is that only one conduit with a pressure level, for instance the lower pressure or the higher pressure, is routed through a media distributor.

In the rotating part a pressure reservoir is then filled with a high volume at a higher pressure p1 by means of a regulating valve (which can preferably be steam-treated). This pressure reservoir can be designed for example as a ring bowl. Thus the pressure reservoir preferably provides the higher pressure. As mentioned, this pressure reservoir may be designed as an annular conduit and in this case can have a plurality of relatively separate stations.

In a preferred embodiment the pressure reservoir is arranged on a device of the transport device. Thus for example, as mentioned above, in the case of a carousel a rotating wheel can be provided, on which in turn the pressure reservoir is arranged. A plurality of the above-mentioned stations which serve for processing the containers can also be provided on this wheel.

In a further preferred embodiment the apparatus has a plurality of application devices, and preferably a plurality of these application devices are supplied with at least one pressure by a common pressure reservoir.

In a further preferred embodiment a pressure is provided by means of a stationary supply device. In particular this is the lower pressure. This pressure is preferably distributed to the individual stations by means of a distribution device, for example a so-called rotary distributor.

The higher pressure is provided or supplied by means of a rotary distributor. This pressure can be reduced by means of a reducing device, for example by means of a regulating valve. In this way may the precision in the application of pressure to the containers can be ensured by means of the pressure reservoir.

In a further preferred embodiment the different pressures are provided to the container by means of at least two feed conduits. Thus it is possible that a pressure chamber is applied to the head space of the container or to the closure and this pressure chamber can be supplied by the two conduits. By means of this pressure chamber the pressure can enter the interior of the container.

In a further preferred embodiment the apparatus has at least one sealing device which seals the container and/or the container closure during the application of pressure. Thus it is possible that the container itself is advanced onto a sealing surface of an application head. In addition, however, it would also be possible to lower the head onto the container. Besides or in addition it would also be possible to push the container in laterally and thus to produce the sealing between the container and the processing head.

In order to apply pressure to the interior of the container, sealing can take place on the upper side of the closure. In the prior art this is achieved by advancing the entire processing head. In this case it is a disadvantage that the head must be moved with the entire periphery and as a result the service life of the connectors and seals is shortened.

In addition the sealing movement can be carried out by the lifting of the containers. As a result the processing head remains permanently in a fixed position and is not damaged by continuous movement. During lifting of the bottle only a bottle holder, for example a clip, has to be moved.

It is also possible to achieve the sealing between the processing head and the container closure without a movement of the two components. In this case an additional intermediate piece is pushed between both sealing surfaces.

For application of pressure or for pressure equalisation of a container which is already closed can be sealed at the location at which the containers are to be opened.

In a further advantageous embodiment the apparatus has a regulating device for at least one of the pressures or one of the pressure stages. Thus such a regulating device can be arranged in particular on the storage device.

Thus it would be possible for example that a pressure transmitter is provided on or in the pressure reservoir in order regulate the pressure. Furthermore, the outlets to the processing stations can be provided on the pressure reservoir in order to set the required final pressure in the containers.

The media distributor used here can be held quite simply, and thus the construction of the entire machine can also be simplified. The required pressure level can be set very precisely by the volume of the pressure reservoir for the low pressure, since a decoupling of the high pressure is produced. It is therefore possible that the pressure reservoir serves both for provision of a high pressure and also for provision of a low pressure.

Furthermore, it is also possible that the said pressure reservoir is sterilised, for example with steam. By means of a regulating valve which is used for feeding the storage device different target pressures can also be set independently depending upon the required container pressure.

Thus it is possible to dispense with a change of elements, such as for example diaphragms. In addition, a precise setting of the processing time is also no longer as significant as in the prior art. By an (optionally additional) use of diaphragms for reduction of the pressure from p1 to p2 it would also be possible, for example in the event of an excessively long processing time, to obtain a pressure which is much too high in the head space, which would lead to an instability of the process.

In a further advantageous embodiment the said application device for the containers is arranged on the transport device. As mentioned above, in this case a plurality of such application devices can be provided.

In a further preferred embodiment the pressure reservoir can be cleaned and/or sterilised by means of a cleaning conduit and/or a sterilisation conduit.

In a further preferred embodiment the apparatus has a recycling device which is suitable and intended for at least partially recovering a gaseous medium and in particular the medium described above for application to the containers. Thus nitrogen consumption can be reduced by pressure recycling.

In a further preferred embodiment a piercing position of the penetration device relative to the container can be varied and/or set. In particular, however, this can in particular take place, but not exclusively, due to a position of the penetration device and/or a needle being variable relative to the region of the container and in particular of the container closure to be pierced and in particular perpendicular to the longitudinal direction of the container.

In this way for example a closure can be pierced at substantially any positions. The piercing in the container lid can preferably take place centrally. It is also possible to process the container closure in a directional position, so that in the case of a lid design or closure design this is not damaged by the needle and/or welding.

The piercing and welding of other container regions is possible, for instance via the bottle base. In this case the container is preferably processed via the base (for example injection point of the preform), so that no discernible engagement on the container can be seen.

In order to change and in particular to increase the processing speed, the number or also the size of the holes can be varied. The at least one hole can preferably have a diameter of 0.05 mm-4 mm, preferably 0.1 mm-2 mm.

Likewise the shape of the holes can vary, for example a round, square, triangular or oval shape is possible. Alternatively the hole shape could be a polygon.

In the event of a plurality of holes there are the possibilities of welding ah holes with a welding punch or a number of welding punches corresponding to the number of holes/needles. It is also possible that a plurality of welding punches are provided, wherein however at least individual ones of the plurality of welding punches weld a plurality of holes.

Furthermore, the welding punch can include a pattern, for example a logo, a diamond pattern or also a chequerboard pattern which is transferred to the container in the welding process. An advantage in this case is the minimising of external influence by third parties (it is difficult to imitate this shape).

Moreover, a blank closure can be used and a branding can be applied by the welding.

Several methods can be used for closing and/or welding the pierced hole. In one method the containers or closures (plastic) can be closed by means of heat/warmth. This can take place in particular but not exclusively by the use of microwave heating devices, infrared heating devices, ultrasonic heating devices, soldering irons/heating dies, laser devices, hot air application devices or the like.

A further possibility is (alternatively or additionally) to close the hole again by means of delivery of material. This can take place for example by means of application devices for applying adhesives or hot plastics.

In a further embodiment the apparatus has a seating device which is suitable and intended for sealing a reclosed container. In this case this sealing can serve both as mechanical protection of the weld against damage and environmental influences, and also to guarantee the integrity of the product.

Furthermore, it would also be possible that a sealing pattern is applied by means of a laser.

Furthermore, the present invention is directed to a method for producing containers which are filled with liquids and closed, wherein containers filled with a liquid and closed by a closure are transported by a transport device, and an opening is produced in at least one region of the closure and/or of the container by a penetration device, and wherein a flowable and in particular gaseous medium is applied to an interior of the container through the opening by an application device and then the opening is closed again by a closing device.

Therefore in terms of the method a possibility is proposed in order to provide a method suitable for the production.

In a first embodiment—in particular according to the invention—at least one region of the container and/or of the closure is sterilised. Also in terms of the method it is proposed here that sterilisation of a region of the container and/or of the closure and/or of a region of the device, such as for instance the penetration device or the application device and/or the closing device, takes place.

In a preferred method, sterilisation takes place after the perforation of the closure or of the container. In this case sterilisation can take place in the time period in which the container is opened and acted upon. However, it would also be possible that the sterilisation already takes place before the perforation of the closure and/or of the container.

In a further embodiment according to the invention the closing device closes the opening by the action of ultrasound. As mentioned above, a sonotrode is particularly preferably used for this purpose.

Particularly preferably at least one element of the closing device contacts a region of the opening at least temporarily during the closing process. Particularly preferably in this case at least one element of the closing device is advanced towards a region of the opening and/or the closure and/or the region of the container which has been perforated.

Drives, such as in particular pneumatic, electric or hydraulic drives for example can be used for this purpose. Besides or in addition it would also be possible to use guide cams which facilitate the respective movements.

In a further preferred method the closing device at least temporarily sets at least a portion of the container or of the closure in mechanical oscillation. Material to be heated is particularly preferably heated and in particular melted by this mechanical oscillation and thus the closing is ultimately achieved. Particularly preferably, by this oscillation an at least partial melting of the region to be closed is achieved.

In a preferred method, for melting or for application, a frequency is used which is greater than 5 kHz, preferably greater than 10 kHz and preferably greater than 20 kHz. Particularly preferably, a frequency is used which is less than 80 kHz, preferably less than 50 kHz, preferably less than 40 kHz, and particularly preferably less than 35 kHz.

In a further preferred method the closing process is monitored at least temporarily by means of a sensor device. In this case for example an output of the closing device or of the above-mentioned sonotrode can be measured. It would also be possible that a camera is provided which monitors the closing process by means of ultrasound.

In a further method according to the invention at least one device of the apparatus is inspected by means of an inspection device and/or by means of a monitoring device at least one parameter is monitored which is characteristic for the production of the filled containers.

In this embodiment it is proposed that either the device or the plant part thereof monitors itself, in particular and not only exclusively the penetration device, the application device and/or the closing device and/or that the processed container is monitored, wherein here for example a pressure monitoring or the like can be carried out.

Alternatively and/or additionally the actual treatment process can be monitored.

In a preferred method at least one value is output which is characteristic for the device of the machine and/or for the production of the filled containers. The machine is particularly preferably controlled on the basis of this value.

In a further preferred method the above-mentioned production of the opening in the closure and/or the application and/or the closing takes place in a first operating mode of the device.

In one embodiment according to the invention, in a second operating mode at least one device of the application device is cleaned and/or sterilised by means of a cleaning and/or sterilising medium. In this embodiment it is generally proposed that sterilisation and/or cleaning of devices and/or plant parts is carried out. In this case this cleaning and/or sterilisation can take place in particular by a cleaning and/or sterilising medium.

In a preferred method the cleaning and/or sterilisation takes place by means of a flowable cleaning and/or sterilising medium. In this case, as mentioned above, this may be for example steam, hydrogen peroxide or the like.

In a further preferred method the cleaning and/or sterilising medium is provided by a stationary feeding device. In this case, particularly preferably, this feeding can take place during a movement of the application device. However, it would also be possible that the feeding of the cleaning and/or sterilising medium takes place in a stationary state of the application device. Particularly preferably, the cleaning and/or sterilising medium is provided via the same route as the flowable medium which is applied to the containers. Particularly preferably the cleaning and/or sterilising medium is provided by means of a rotary distributor.

In a further preferred method a pressure reservoir of the device is also cleaned by means of the cleaning and/or sterilising medium.

Furthermore, it is preferably also possible that a plurality of feed conduits for the flowable medium are cleaned with the cleaning and/or sterilising medium.

In a further embodiment of the method according to the invention a first pressure and a second pressure of the flowable medium different from the first is applied to the container of the application device.

Preferably first of all a higher pressure and then a lower pressure is applied to the container.

In a preferred method the low pressure is provided by a pressure reservoir.

BRIEF DESCRIPTION OF THE DRAWINGS

Further advantages and embodiments are apparent from the appended drawings.

In the drawings.

DETAILED DESCRIPTION OF THE INVENTION

Figure 1A:
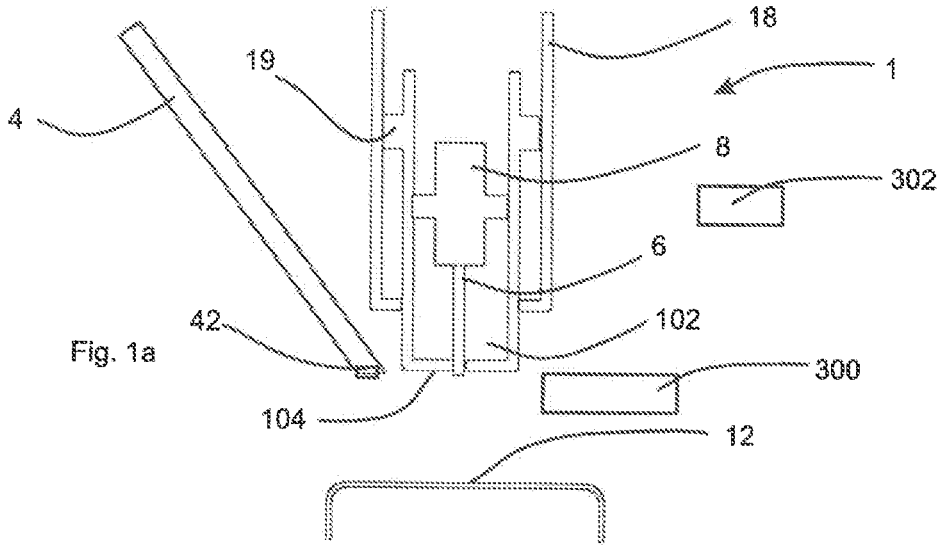
FIGS. 1*a*-1*h* show schematic representations of a device according to the invention for illustration of a method to be carried out.

FIG. 1*a* shows a schematic representation of a apparatus 1 according to the invention for processing containers. Only a closure 12 of the container is illustrated here. The apparatus according to the invention has a penetration device 6 which is configured here as a needle and which is intended to pierce a predetermined region of the closure 12. Here this penetration device 6 is arranged movably on a driving device and thus in FIG. 1*a* it can be advanced in a vertical direction towards the closure and can pierce it.

The reference sign 104 designates a guiding device which serves here for guiding the penetration device 6. The reference 102 roughly designates a guide cylinder, inside which the penetration device 6 is movable with its driving device 8.

The reference 19 designates a further driving device, which overall is likewise movable in the vertical direction relative to a housing 18. At the same time a pressure can be introduced into the container by the application device 8. The reference 4 designates a closing device which is intended to close the container closure again after the piercing and the filling with the gas.

In one embodiment this closing device can have an ultrasound generating device 42. This can be applied to the closure and can heat it locally by oscillations so much that melting of the (plastic) material of the closure 12.

The reference 300 designates quite schematically an inspection device which is suitable and intended to inspect devices of the apparatus 1 and/or also to inspect a work result, for instance a drilled hole. In this case it is possible that such inspection devices are arranged stationary and the apparatus shown in FIG. 1*a* moves past them.

However, it would also be conceivable that the inspection device is arranged stationary relative to the apparatus shown in FIG. 1*a*, for example on the transport device (not shown), on which the apparatus itself is also arranged.

The reference 302 designates quite schematically a monitoring device which monitors the process described above, for instance by monitoring pressures, temperatures or other process parameters.

Figure 1B:
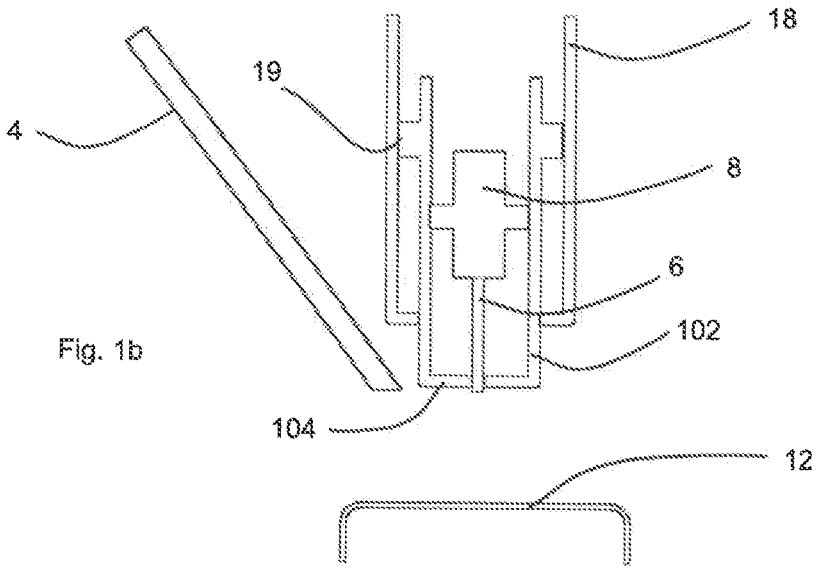

In the situation shown in FIG. 1*b* no element of the machine is advanced towards the container closure, so that in this way the beginning of a corresponding method is marked.

Figure 1C:
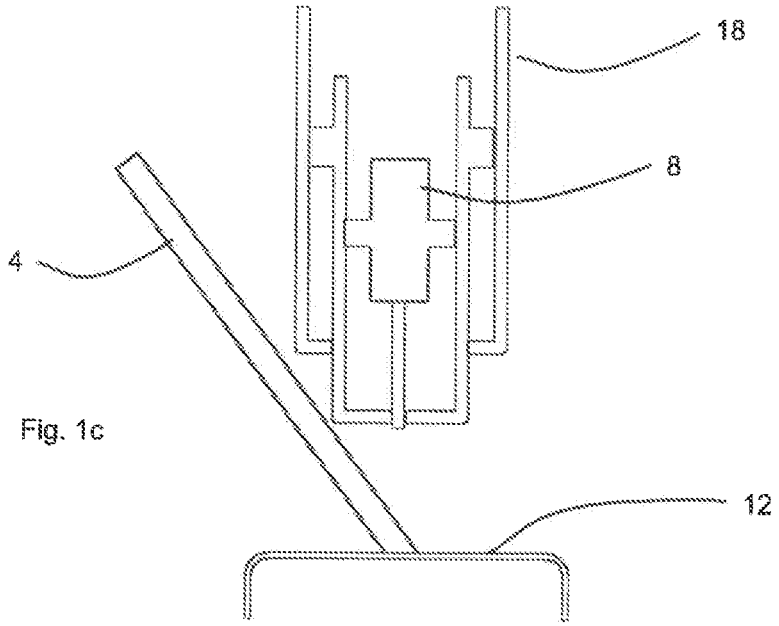

In the representation shown in FIG. 1*c*, first of all the closing device, for instance a temperature regulating element, is advanced towards the closure, for example in order to melt it or to soften it. However, this method step is optional.

Figure 1D:
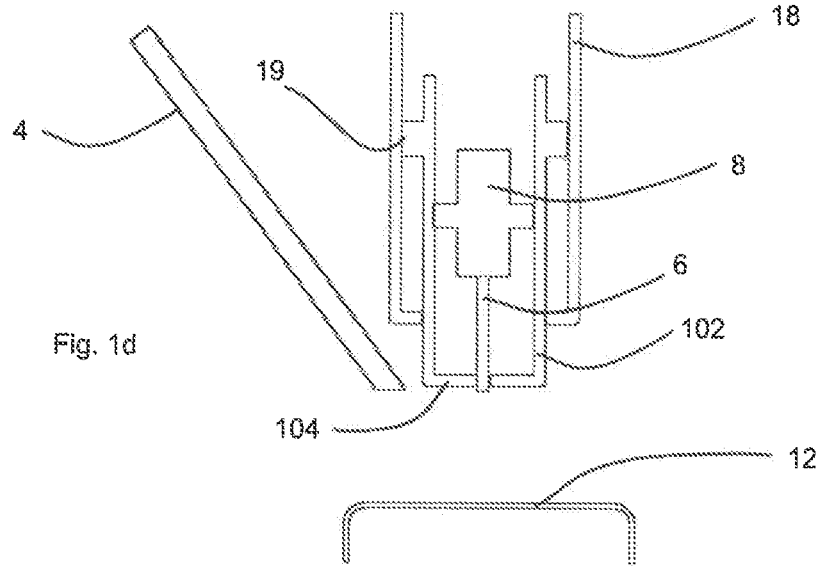

In the situation shown in FIG. 1*d*, the closing device is reset again.

Figure 1E:
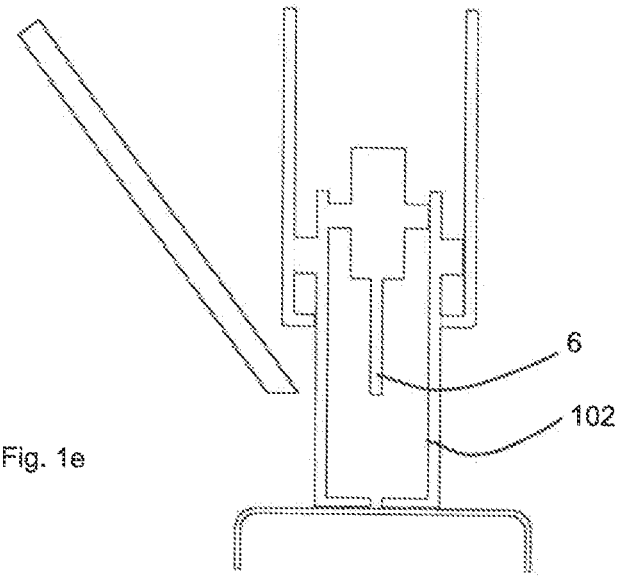

In the situation shown in FIG. 1*e*, first of all the element 102 is advanced towards the closure 12. In this way for example sterilisation of the closure 12 can be achieved for instance in that in the region in which the opening is to be produced the surrounding regions are sterilised, which can take place for example by UV light, as explained in greater detail below, or also by the effect of heat or also by a sterilising medium.

Figure 1F:
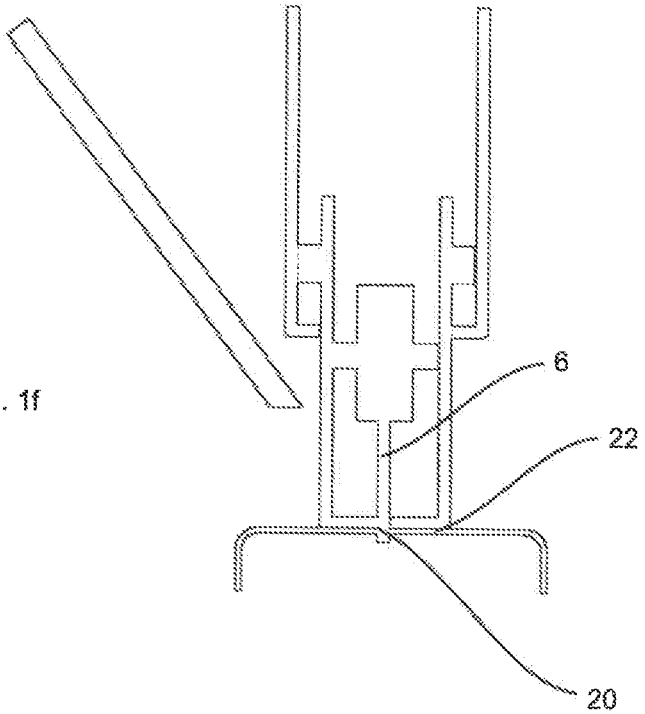
Figure 1G:
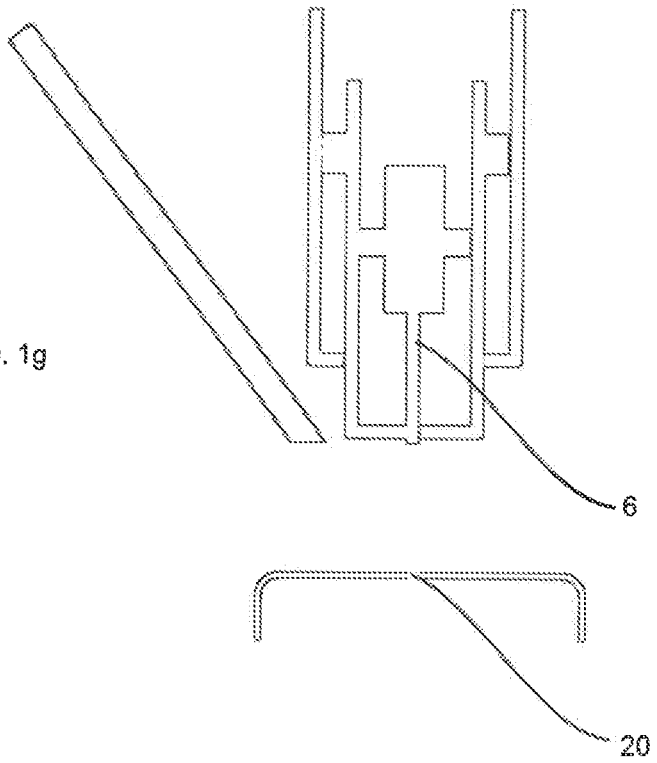
Figure 1H:
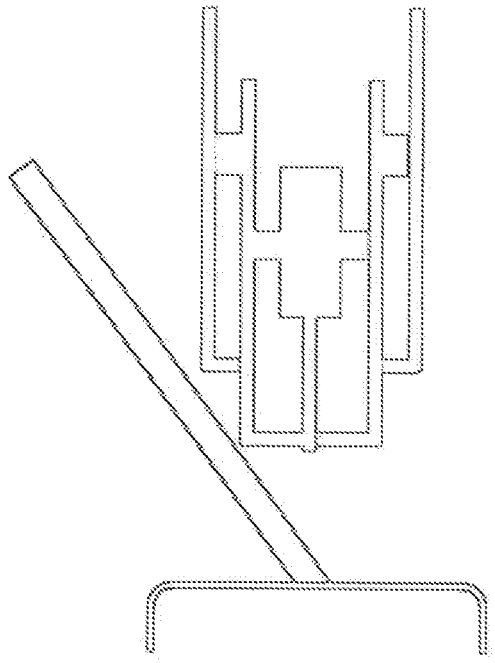

In the situation shown in FIG. 1*f* a hole is pierced in the container closure by means of the penetration device 6. In the situation shown in FIG. 1*g*, the penetration device is retracted. Now on the closure 12 an opening or a hole 20 is produced. In the situation shown in FIG. 1*h*, this hole 20 is closed again. In this case, as mentioned above, this can take place by melting of the material, but a so no trade can also be used, which effects an even more favourable closing of the opening 20.

Figure 2:
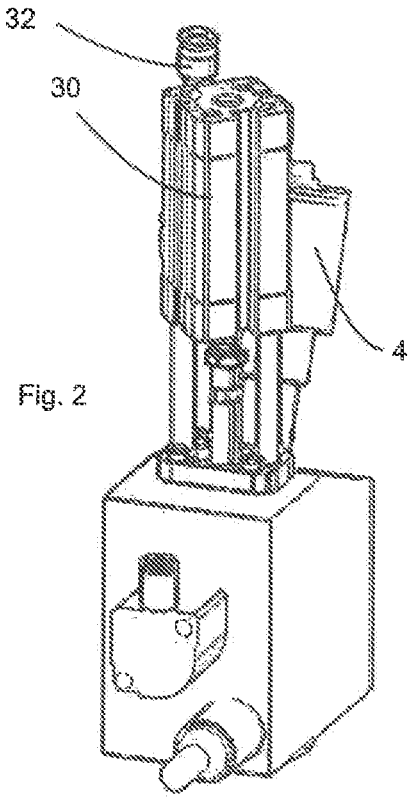
FIG. 2 shows a representation of a device according to the invention in a schematic representation

FIG. 2 shows a representation of a machine according to the invention. In this case a housing 30 is provided, which for example can have a linear drive for a needle and also the sonotrode. The reference 4 in turn designates the closing device which, as shown in FIG. 2 is guided obliquely and thus can also be advanced obliquely towards the container (not shown). The reference numeral 32 designates a compressed air feed line which serves for actuation of the pneumatic drive.

Figure 3:
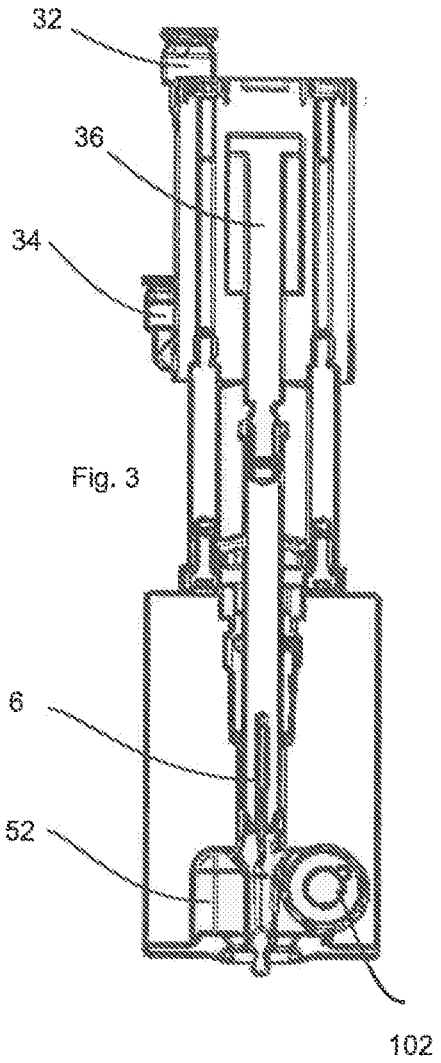
FIG. 3 shows a side view of the representation shown in FIG. 2.

In the situation shown in FIG. 3, in addition to the compressed air feed line 32 a second connector 34 is also evident, which overall can effect the movement of the piston 36.

The reference 6 in turn designates the penetration device and the reference 52 designates a temperature sensor which can for example monitor a temperature of the container closure.

The reference 102 designates a sterilising device which is configured here as a pulsed UV lamp and which sterilises the region of the opening produced or to be produced.

Figure 4:
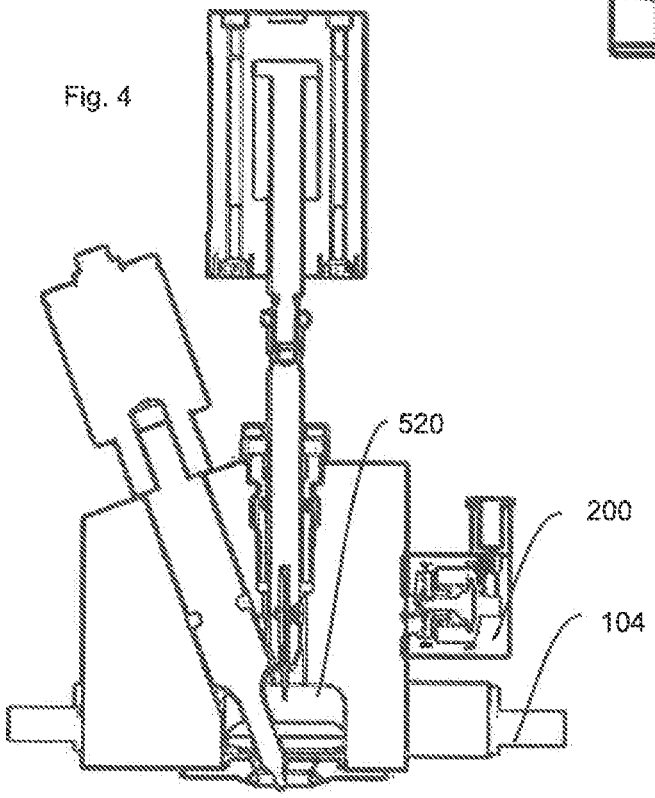
FIG. 4 shows a further side view of the machine shown in FIG. 2.

In the situation shown in FIG. 4 a valve block is provided which can serve for feeding of the gas, for example nitrogen.

In addition, this valve block can also be sterilised by means of a sterilising gas. In addition a sterilisation by means of $H_2O_2$ is also possible.

The reference numeral 104 designates a cooling device for cooling the UV lamp or generally the sterilising device. This may be for example a fluid cooling system.

The reference 520 designates a pressure application chamber, in order to seal the region between the closure and the compressed air application and in order to apply the positive pressure to the container closure and thus also to the container (not shown).

Figure 5:
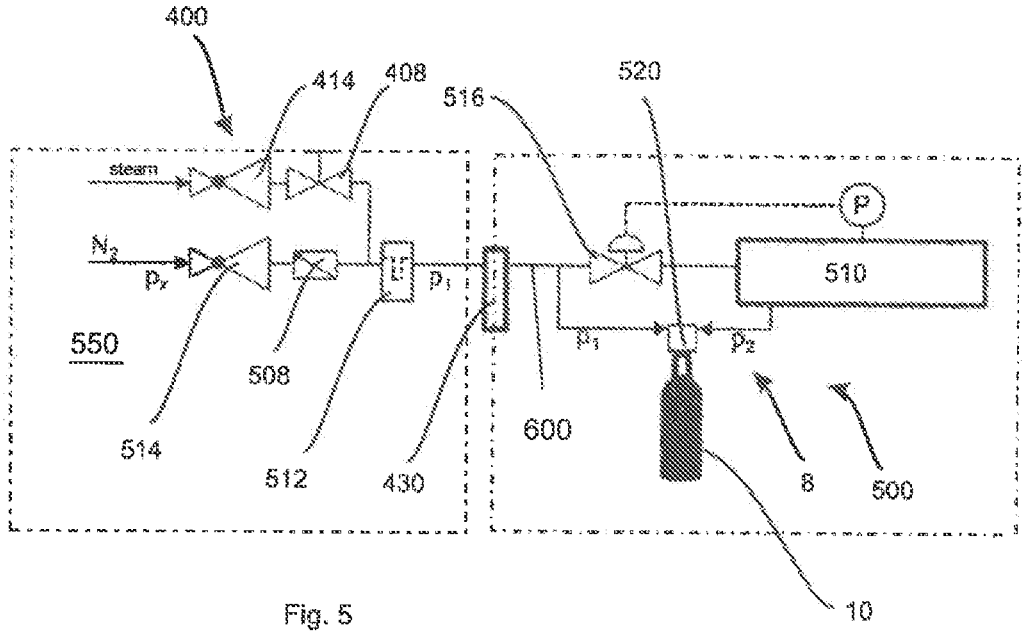
FIG. 5 shows a wiring diagram for illustration of a method according to the invention.

FIG. 5 shows an arrangement in the manner of a circuit diagram of a device according to the invention with a processing station. A container 10 is shown here to which the compressed air is applied. An application chamber 520 is also provided in turn, which here can be provided with pressures p1 and p2 by means of two compressed air lines. First of all a pressure Px can be supplied via a pressure reservoir 514 by means of a regulation stage 508 and a regulation unit 512 to a rotary distributor or selection device 430.

This rotary distributor 430 distributes the compressed air to the individual containers or the individual application devices. The reference 500 designates the application device as a whole.

The reference 510 designates a pressure reservoir, which is provided for storing a specific pressure, either the higher pressure p1 or the lower pressure p2.

The reference 516 designates a regulating valve which is suitable for regulating the pressure P exiting from the reservoir onto the individual containers.

In addition the cleaning function of the device is shown. Here again a reservoir 414 is provided, which for example can provide a cleaning agent such as steam. The reference 408 designates a valve which can effect the feeding of steam from a stationary feeding device 550 via a conduit 600 into the device 512, the rotary distributor 430, but also the individual conduits of the application device 500.

Figure 6:
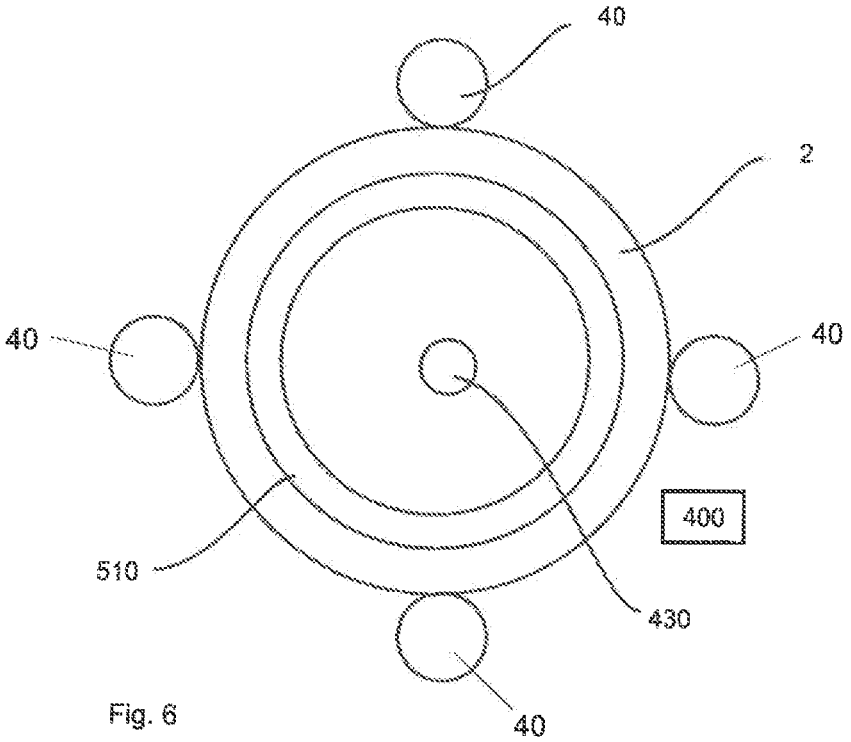
FIG. 6 shows a rough schematic representation of a device according to the invention.

FIG. 6 shows a schematic representation of a device 1 according to the invention. A transport device 2 is provided here which can be designed for instance as a rotatable support. A plurality of processing stations 40 are provided on this support and, as mentioned above, the processing stations here can have the individual devices, such as the application device and the like.

The reference 430 in turn designates a rotary distributor and the reference 510 quite schematically designates the reservoir which can serve for holding or for storing a pressure stage.

The applicant reserves the right to claim all the features disclosed in the application documents as essential to the invention in so far as they are individually or in combination novel over the prior art. Furthermore it is pointed out that features which may be advantageous per se have also been described in the individual drawings. The person skilled in the art recognises immediately that a specific feature described in a drawing may also be advantageous without foe incorporation of further features from this drawing. Furthermore the person skilled in the art recognises that advantages may also result from a combination of several features shown in individual drawings or in different drawings.

LIST OF REFERENCES

1 device/apparatus
2 transport device
4 closure device
6 penetration device
8 application device
10 container
12 closure
18 housing
19 driving device
20 hole
30 housing
32 compressed air supply
34 second connector
36 piston
40 processing stations
42 ultrasound generating device
52 temperature sensor
102 guide cylinder
102 element
102 sterilising device
104 guiding device
104 cooling device
408 valve
414 reservoir
430 rotary distributor
300 inspection device
302 monitoring device
500 application device
508 regulation stage
510 pressure reservoir
510 reservoir
512 regulating unit
514 pressure reservoir
516 regulating valve
520 pressure application chamber
P1 higher pressure
P2 lower pressure
PX pressure

The invention claimed is:

1. An apparatus for producing filled containers with a transport device which is configured for transporting containers which are filled with a liquid and closed by a closure, with a penetration device which is configured to produce an opening in at least one region of the closure and/or of the container, with an application device which is configured to apply a flowable and in particular gaseous medium to an interior of the container through the opening, and with a closing device which is configured to close the opening, wherein the apparatus has at least one cleaning and/or sterilising device, which is configured for cleaning and/or sterilising at least one device of the application device, and wherein the cleaning and/or sterilising device is configured to apply a flowable cleaning medium to devices of the application device, wherein the cleaning and/or sterilising device is active in a cleaning mode, which differs from an operating mode, in which the containers themselves are processed.

2. The apparatus according to claim 1, wherein the application device has at least one feed conduit configured to feed the medium to the interior of the container and the sterilising device is configured for flushing the feed conduit with a cleaning and/or sterilising medium.

3. The apparatus according to claim 1, wherein the cleaning and/or sterilising device has at least one stationary feeding device for a cleaning and/or sterilising medium.

4. The apparatus according to claim 1, wherein the application device is arranged on the transport device.

5. The apparatus according to claim 1, wherein the apparatus has a distribution device configured to distribute at least one flowable medium from a stationary feeding device to a plurality of application devices.

6. The apparatus according to claim 1, wherein the apparatus has a stationary supply device configured to supply the flowable medium.

7. The apparatus according to claim 6, wherein the apparatus has a selection device configured to enable selective feeding of the application device with the flowable medium or the cleaning and/or sterilising medium.

8. A method for producing containers which are filled with liquids and closed, wherein containers filled with a liquid and closed by a closure are transported by a transport device, and an opening is produced in at least one region of the closure and/or of the container by a penetration device, and wherein in a first operating mode a flowable and in particular gaseous medium is applied to an interior of the container through the opening by an application device, and then the opening is closed again by a closing device, wherein in a second operating mode at least one device of the application device is cleaned and/or sterilised by a cleaning and/or sterilising medium, and wherein the cleaning and/or sterilising device is configured to apply a flowable cleaning medium to devices of the application device, wherein the cleaning and/or sterilising device is active in a cleaning mode, which differs from an operating mode, in which the containers themselves are processed.

9. The method according to claim 8, wherein the cleaning and/or sterilisation takes place by a flowable cleaning and/or sterilising medium.

10. The method according to claim 9, wherein the cleaning and/or sterilising medium is provided by a stationary feeding device.

11. The method according to claim 8, wherein the cleaning and/or sterilising medium is provided by a stationary feeding device.

12. The method according to claim 8, wherein the apparatus has a sterile room inside which the containers are at least partially transported.

13. The method according to claim 8, wherein an inspection device is provided, which facilitates thermal monitoring of the welding point.

14. The method according to claim 8, wherein a plurality of feed conduits for the flowable medium are cleaned with the cleaning and/or sterilising medium.

15. The method according to claim 8, wherein the cleaning and/or sterilising medium is provided via the same route as the flowable medium which is applied to the containers.

* * * * *